US011363899B1

(12) United States Patent
Hung

(10) Patent No.: US 11,363,899 B1
(45) Date of Patent: Jun. 21, 2022

(54) COLLAPSIBLE HANGER

(71) Applicant: Yu-Ting Hung, Taipei (TW)

(72) Inventor: Yu-Ting Hung, Taipei (TW)

( * ) Notice: Subject to any disclaimer, the term of this patent is extended or adjusted under 35 U.S.C. 154(b) by 0 days.

(21) Appl. No.: 17/665,106

(22) Filed: Feb. 4, 2022

(30) Foreign Application Priority Data

Feb. 4, 2021 (TW) ..... 110104234

(51) Int. Cl.
*A47G 25/40* (2006.01)

(52) U.S. Cl.
CPC ..... *A47G 25/40* (2013.01); *A47G 25/403* (2013.01)

(58) Field of Classification Search
CPC ..... A47G 25/40; A47G 25/24; A47G 25/26; A47G 25/28; A47G 25/30; A47G 25/32; A47G 25/36; A47G 25/52; A47G 25/448; A47G 25/4015; A47G 25/403; A47G 25/4092
USPC ..... D6/315, 317, 324
See application file for complete search history.

(56) References Cited

U.S. PATENT DOCUMENTS 586,456 A * 7/1897 Rideout ..... A47G 25/24 223/88
869,245 A * 10/1907 Johnson
906,323 A * 12/1908 Spruce et al.
917,314 A * 6/1909 Kruth ..... A47G 25/4015 223/85
2,558,583 A * 6/1951 Robins ..... A47G 25/4061 16/374
2,812,888 A * 11/1957 Henderson ..... A47G 25/24 223/88
5,810,216 A * 9/1998 Leopold ..... A47G 25/403 223/94
2005/0242135 A1 11/2005 Lam
2016/0120350 A1* 5/2016 Tsukada ..... A47G 25/4015 223/85

FOREIGN PATENT DOCUMENTS

CN 2367196 Y 3/2000
TW M425885 U 4/2012
TW M611514 U 5/2021
WO 2018/074685 A1 4/2018

* cited by examiner

*Primary Examiner* — Ismael Izaguirre
(74) *Attorney, Agent, or Firm* — Muncy, Geissler, Olds & Lowe, P.C.

(57) ABSTRACT

A collapsible hanger includes a hook unit, a first hanger body, and a second hanger body. The hook unit has a hook and a pair of pivot shafts. The first hanger body has a pair of first extensions and a pair of first pivot rings, which are pivotally sleeved on the pivot shafts respectively. The second hanger body has a pair of second extensions, a pair of second pivot rings, and at least one stop section. The second pivot rings are pivotally sleeved on the pivot shafts respectively. The stop section is fixed on one of the second pivot rings. When the first and second hanger bodies are at their respective extended positions and the hook is in a top-side space, the stop section and at least one of the first extensions interfere with each other such that the two hanger bodies cannot pivot away from the hook simultaneously.

10 Claims, 8 Drawing Sheets

COLLAPSIBLE HANGER

BACKGROUND OF THE INVENTION

1. Technical Field

The present invention relates to a clothes hanger and more particularly to a collapsible hanger with spiral hinge structures composed of mutually engaged parts, wherein the collapsible hanger has a sturdy and durable design free of adhesive, rivets, solder joints, and screws, can be assembled and disassembled without using tools, and includes exchangeable structural units that allow partial replacement to extend the service life of the collapsible hanger and to prevent a wasteful use of the structural units.

2. Description of Related Art

Hangers are household articles for daily use, from which clothes can be hung in order to be dried after washing or to be put away in a closet. A hanger generally has two arms that resemble the human shoulders in shape so as to support clothes. If a sweater or T-shirt, whose neck hole is relatively small, is to be hung by inserting a hanger through the neck hole, the aforesaid shape of the hanger arms requires that the neck hole be pulled wide open to facilitate the insertion. The pulling action, however, may render the neck of the clothes loose or deformed.

To protect the neck of a garment from damage by the foregoing pulling action, an alternative approach is to insert the two arms of a hanger into the bottom opening of the garment and allow the hook of the hanger to move through the waist and chest portions of the garment and then jut out of the neck hole. During the process, however, the hook element may become entangled with, and thus damage, the garment. This alternative operation is also not very efficient. Moreover, if the garment has buttons leading to the neck hole, a required number of the buttons must be undone before the hanger can be removed.

In addition, the alternative approach described above fails to satisfy actual needs and is time-consuming.

For example, where sweaters and T-shirts are displayed for sale, it is often necessary to hang and remove the garments from their hangers frequently and repeatedly. The operations of hanging the garments from the hangers and taking the garments off the hangers, therefore, should be as easy as possible.

BRIEF SUMMARY OF THE INVENTION

The primary objective of the present invention is to provide a collapsible hanger that will not be elastically fatigued.

To achieve the above and other objectives, the present invention provides a collapsible hanger (also referred to herein as the "hanger" for short) that includes a hook unit, a first hanger body, and a second hanger body. The hook unit has a hook and a pair of coaxially extending pivot shafts. The first hanger body has a pair of first extensions and a pair of first pivot rings. The first hanger body can be pivoted between a first collapsed position and a first extended position with respect to the hook unit. The pair of first pivot rings are connected to the pair of first extensions respectively and are pivotally sleeved on the pair of pivot shafts respectively. The second hanger body has a pair of second extensions, a pair of second pivot rings, and at least one stop section. The second hanger body can be pivoted between a second collapsed position and a second extended position with respect to the hook unit. The pair of second pivot rings are connected to the pair of second extensions respectively and are pivotally sleeved on the pair of pivot shafts respectively. The stop section is fixed on one of the pair of second pivot rings. When the first and the second hanger bodies are at the first and the second extended positions respectively, the two hanger bodies separate a top-side space and a bottom-side space from each other, wherein the top-side space is above the first and the second hanger bodies while the bottom-side space is directly below the first and the second hanger bodies. When the first and the second hanger bodies are at the first and the second extended positions respectively and the hook is in the top-side space, the at least one stop section and at least one of the pair of first extensions interfere with each other such that the first and the second hanger bodies cannot pivot away from the hook at the same time but are allowed to pivot toward the first and the second collapsed positions respectively.

The present invention provides an ingenious design in which the at least one stop section and at least one of the pair of first extensions can interfere with each other when at a predetermined position, thereby allowing the collapsible hanger to stay in an extended state naturally without the application of an elastic force and be readily collapsed by its user. The hanger of the invention is structured for easy assembly, will not suffer from elastic fatigue, and can therefore provide both collapsibility and high durability.

DETAILED DESCRIPTION OF THE INVENTION

Figure 1:
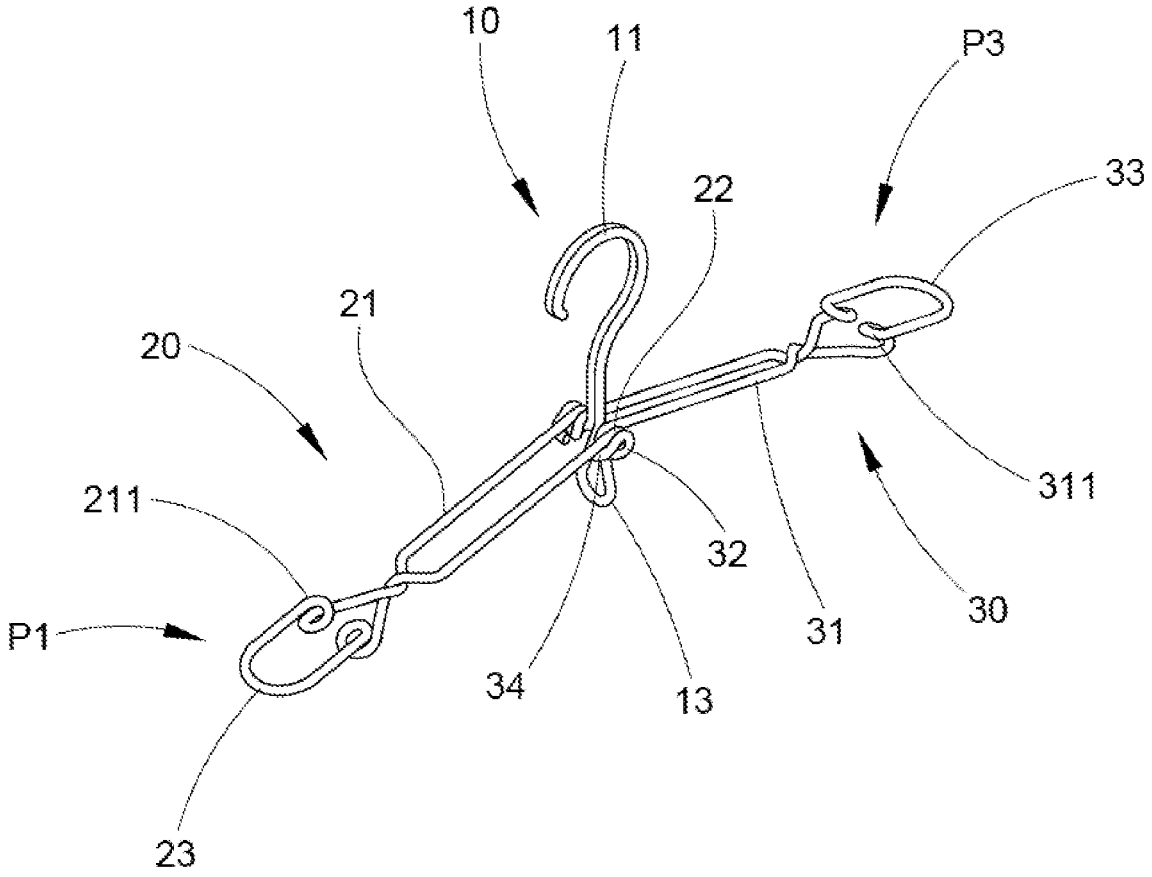
FIG. 1 is a perspective view of the first embodiment of the present invention.

Referring to FIG. 1 to FIG. 4, the collapsible hanger according to the first embodiment of the present invention includes a hook unit 10, a first hanger body 20, and a second hanger body 30.

The hook unit 10 has a hook 11, a pair of pivot shafts 12 that extend coaxially, and a hanging ring 13. The free end of the hook 11 is barb-shaped so that the hook 11 will not be easily separated (e.g., blown away by wind) from the clothes hanging rod from which it hangs. The pivot shafts 12 are located between the hook 11 and the hanging ring 13. The hanging ring 13 is so designed that a plurality of similar hangers can be hung in a cascading manner, with the hook 11 of each but the top hanger connected to the hanging ring 13 of the hanger above it to save storage space. The barb-shaped design also allows each two adjacent ones of the cascading hangers to be securely connected, lest they separate from each other easily.

Figure 2:
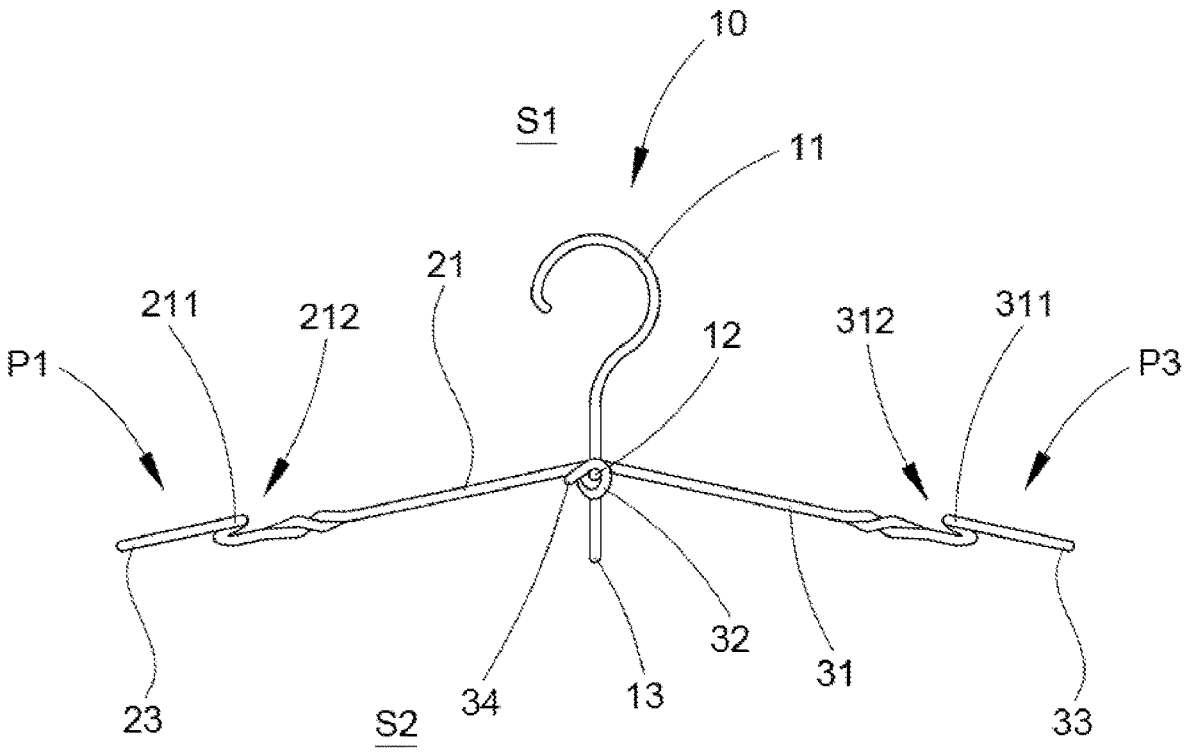
FIG. 2 is a side view of the first embodiment of the invention.
Figure 3:
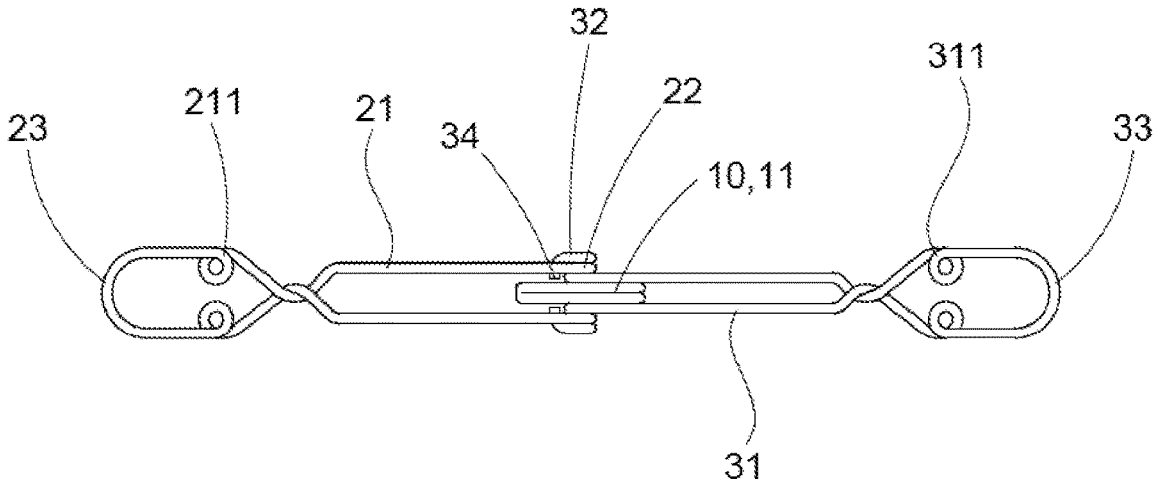
FIG. 3 is a top view of the first embodiment of the invention.
Figure 4:
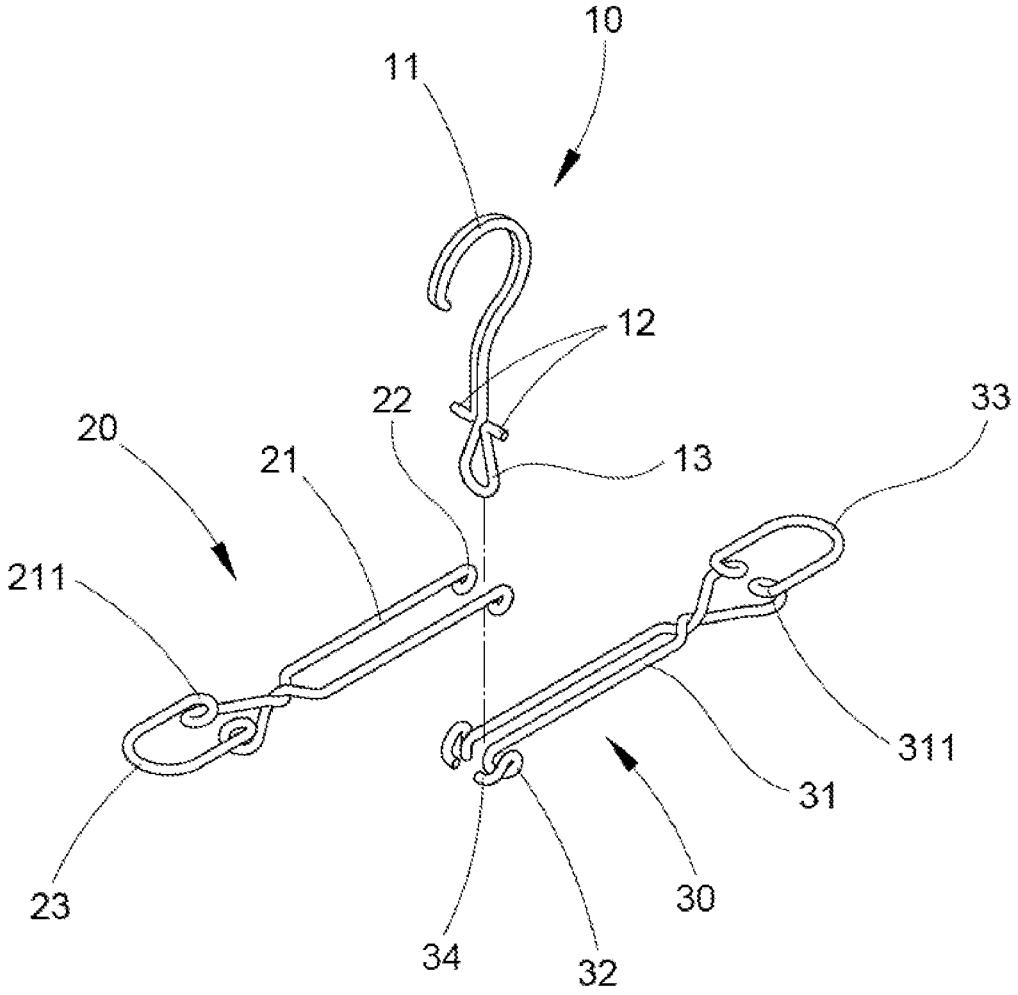
FIG. 4 is an exploded view of the first embodiment of the invention.
Figure 5:
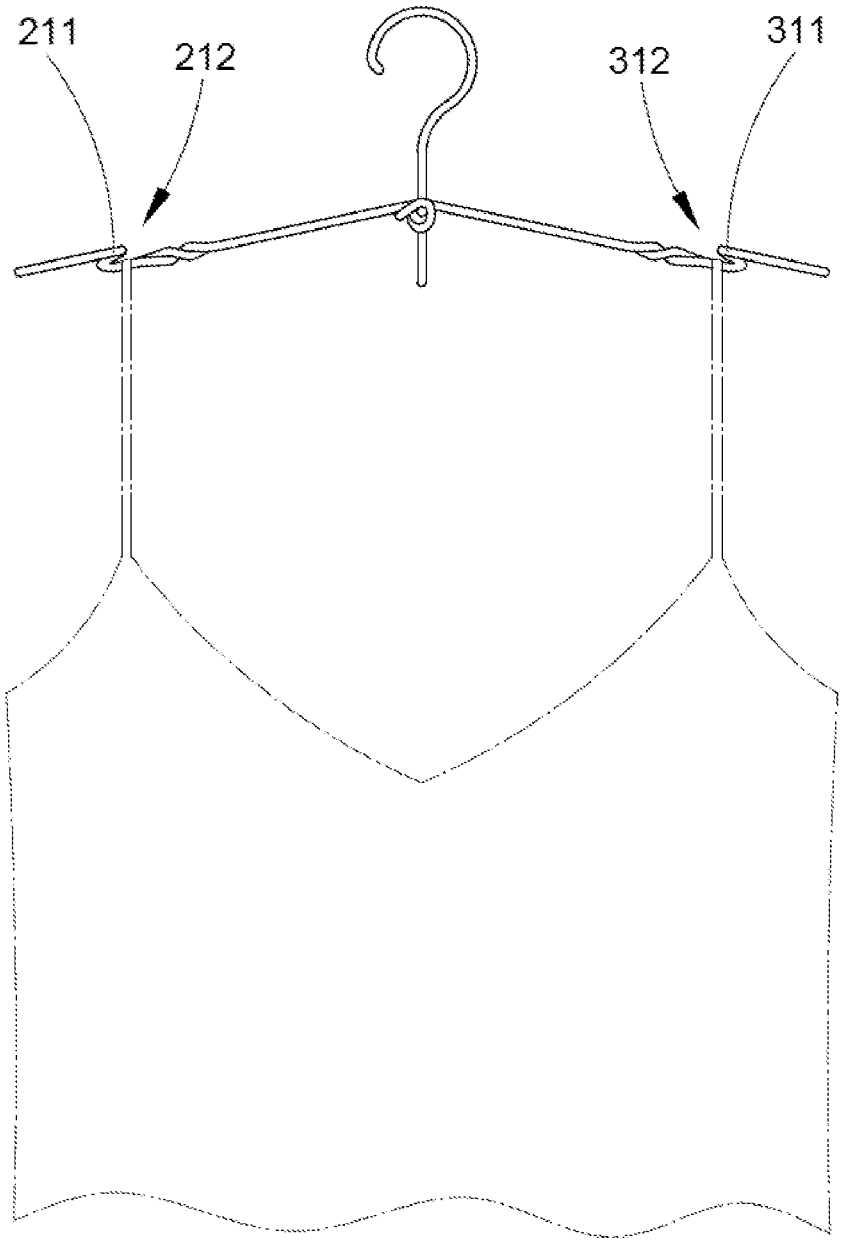
FIG. 5 shows a piece of clothes hanging from the first embodiment of the invention.
Figure 6:
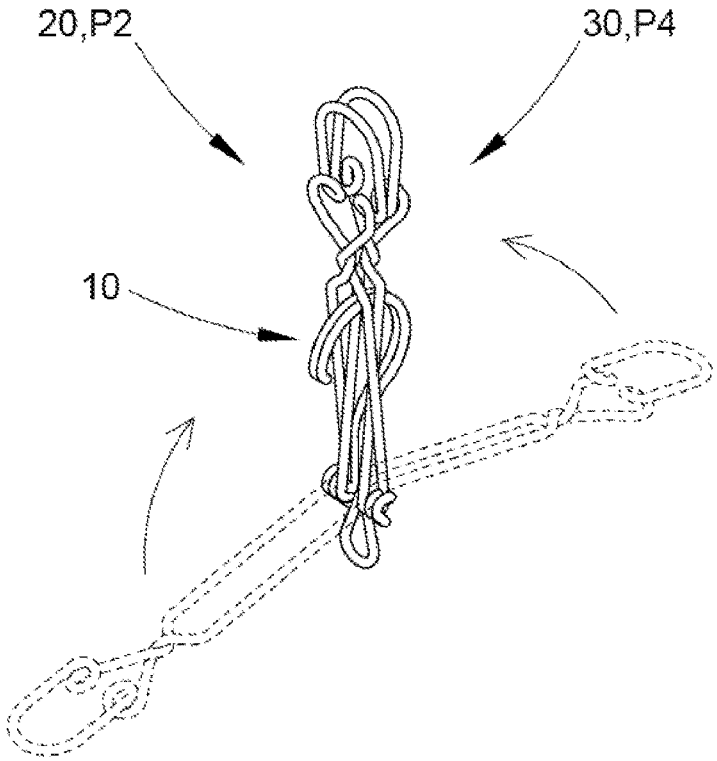
FIG. 6 to FIG. 9 show certain states of use of the first embodiment of the invention.

The first hanger body 20 can be pivoted between a first extended position P1 (as shown in FIG. 1 and FIG. 2) and a first collapsed position P2 (as shown in FIG. 6) with respect to the hook unit 10 and has a pair of first extensions 21, a pair of first pivot rings 22, and a first connecting section 23. The pair of first extensions 21 are connected at one end to the pair of first pivot rings 22 respectively and are connected at the other end to the first connecting section 23. In other words, the first connecting section 23 is located at the end of the pair of first extensions 21 that is distant from the first pivot rings 22, and connects the two first extensions 21 together. The pair of first pivot rings 22 are pivotally sleeved on the pair of pivot shafts 12 respectively. In addition, defined between the pair of first extensions 21 is a gap through which the hook 11 and the hanging ring 13 can pass. Moreover, each first extension 21 has a spiral section 211, and each spiral section 211 defines a groove 212 in which a shoulder strap of a garment to be hung from the hanger (e.g., a shoulder strap of an undervest, brassiere, or dress) can be engaged (as shown in FIG. 5) to prevent the garment from sliding off the hanger when wind blows.

The second hanger body 30 can be pivoted between a second extended position P3 (as shown in FIG. 1 and FIG. 2) and a second collapsed position P4 (as shown in FIG. 6) with respect to the hook unit 10 and has a pair of second extensions 31, a pair of second pivot rings 32, a second connecting section 33, and a pair of stop sections 34. The pair of second extensions 31 are connected at one end to the pair of second pivot rings 32 respectively and are connected at the other end to the second connecting section 33. In other words, the second connecting section 33 is located at the end of the pair of second extensions 31 that is distant from the second pivot rings 32, and connects the two second extensions 31 together. The second pivot rings 32 are pivotally sleeved on the pair of pivot shafts 12 respectively. The pair of stop sections 34 are fixed on the pair of second pivot rings 32 respectively. In other feasible embodiments, the second hanger body may have only one stop section, and in that case the stop section is fixed on one of the pair of second pivot rings. Moreover, defined between the pair of second extensions 31 is a gap through which the hook 11 can pass. Each second extension 31 also has a spiral section 311, and each spiral section 311 defines a groove 312 in which a shoulder strap of a garment to be hung from the hanger (e.g., a shoulder strap of an undervest, brassiere, or dress) can be engaged (as shown in FIG. 5) to prevent the garment from sliding off the hanger when wind blows. The first and the second connecting sections 23 and 33 are so designed that the free ends of the first and the second hanger bodies 20 and 30 have a relatively great width, which not only helps protect the shoulder lines of a garment hanging from the hanger from deformation (e.g., bulging because of the otherwise relatively narrow free ends), but also helps stretch the garment open laterally to speed up air-drying and thereby prevent mold growth.

In this embodiment, each of the hook unit 10, the first hanger body 20, and the second hanger body 30 may be integrally formed by bending a metal wire or metal strip, and each of the first and the second pivot rings 22 and 32 and the corresponding pivot shaft 12 may form a spiral hinge structure such that the hanger of the present invention can be assembled without soldering, adhesive bonding, riveting, or using screws or tools. Thus, the hanger of the invention is structurally simple, easy to manufacture, robust, durable, user-friendly, and operable with one hand.

The working principle of, and the definitions of spaces around, the first embodiment are stated below with reference to the accompanying drawings.

Referring to FIG. 2, the first and the second hanger bodies 20 and 30 separate a top-side space S1 and a bottom-side space S2 from each other when at the first and the second extended positions P1 and P2 respectively. As their names suggest, the top-side space S1 refers to the space above the first and the second hanger bodies 20 and 30, and the bottom-side space S2 refers to the space directly below the first and the second hanger bodies 20 and 30.

When the first and the second hanger bodies 20 and 30 are at the first and the second extended positions P1 and P2 respectively and the hook 11 is in the top-side space S1 (as shown in FIG. 2), the pair of stop sections 34 interfere with the pair of first extensions 21 respectively such that the first and the second hanger bodies 20 and 30 cannot pivot away from the hook 11 (i.e., pivot toward the bottom side of FIG. 2) at the same time but are allowed to pivot toward the first and the second collapsed positions P3 and P4 (i.e., pivot toward the top side of FIG. 2) respectively. The hanging ring 13 in this state is in the bottom-side space S2.

To hang a garment from the hanger of the present invention, either the hook 11 may be brought close to one of the first and the second hanger bodies 20 and 30, or at least one of the first and the second hanger bodies 20 and 30 may be pivoted to the corresponding one(s) of the first and the second collapsed positions P3 and P4, the objective being to reduce the volume of the hanger so that the hanger can be inserted into the neck hole of the garment with ease. Thus, the risk that the neck of the garment may become loose or deformed due to repeated stretching is eliminated or greatly reduced.

To facilitate storage, referring to FIG. 6, the first and the second hanger bodies 20 and 30 can be collapsed to the first and the second collapsed positions P3 and P4 respectively to reduce the space occupied by the hanger.

Figure 7:
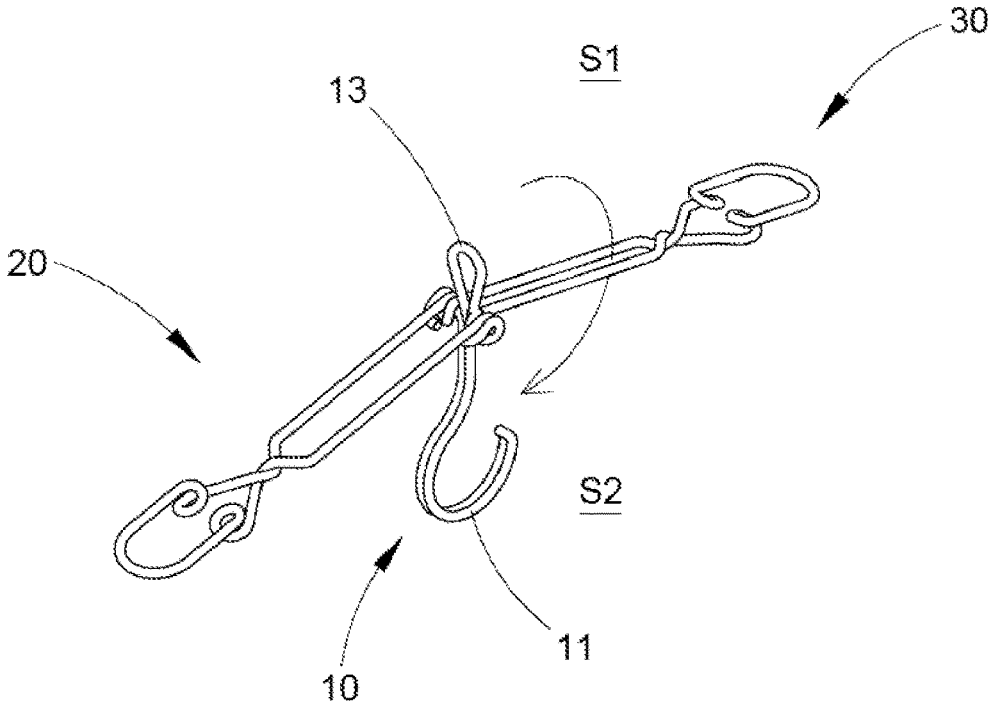
Figure 8:
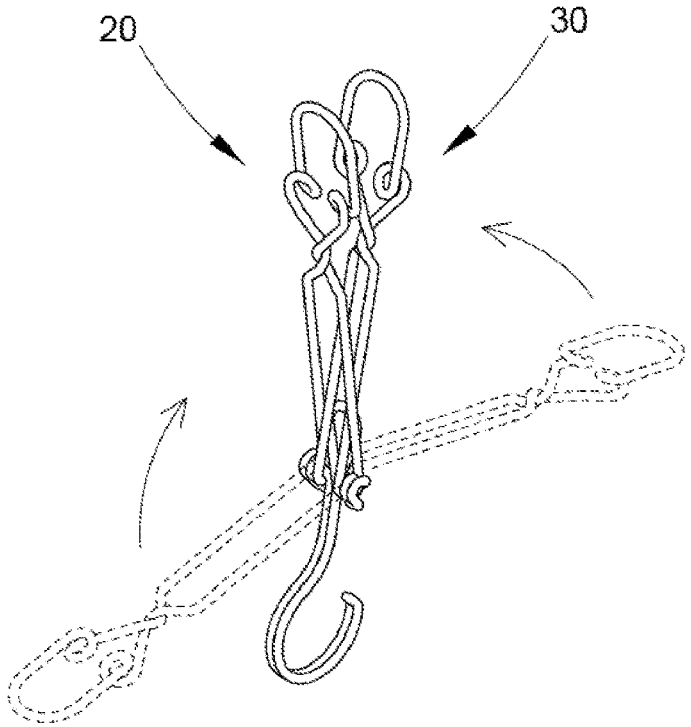
Figure 9:
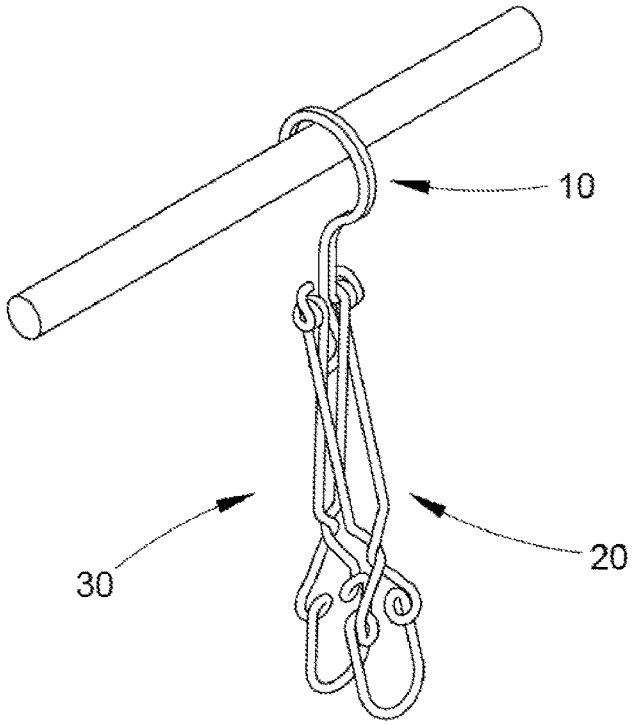

Alternatively, when the first and the second hanger bodies 20 and 30 are at the first and the second extended positions P1 and P2 respectively and the hook 11 is in the top-side space S1 (as shown in FIG. 1 and FIG. 2), the hook unit 10 can be pivoted with respect to the first and the second hanger bodies 20 and 30 (as shown in FIG. 7) in such a way that the hook 11 is pivoted to the bottom-side space S2 while the hanging ring 13 is pivoted to the top-side space S1. Then, the first and the second hanger bodies 20 and 30 can be brought close to each other (as shown in FIG. 8), before the hanger is inverted and hung from a rod (as shown in FIG. 9). This alternative storing configuration can reduce the space occupied by the hanger just as well.

Figure 10:
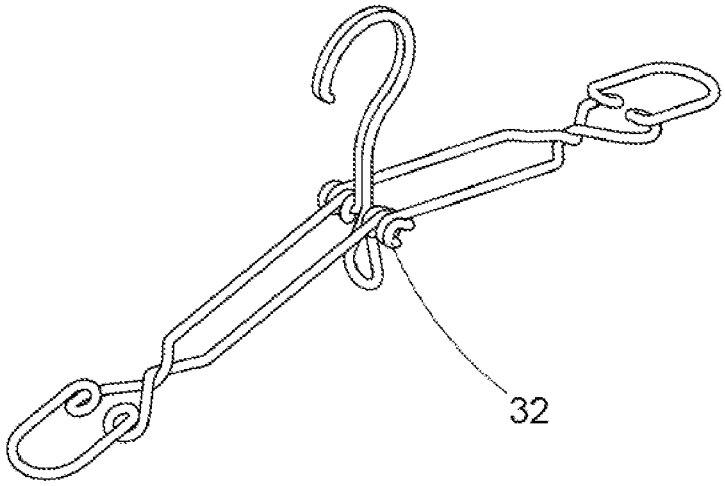
FIG. 10 is a perspective view of the second embodiment of the invention.
Figure 11:
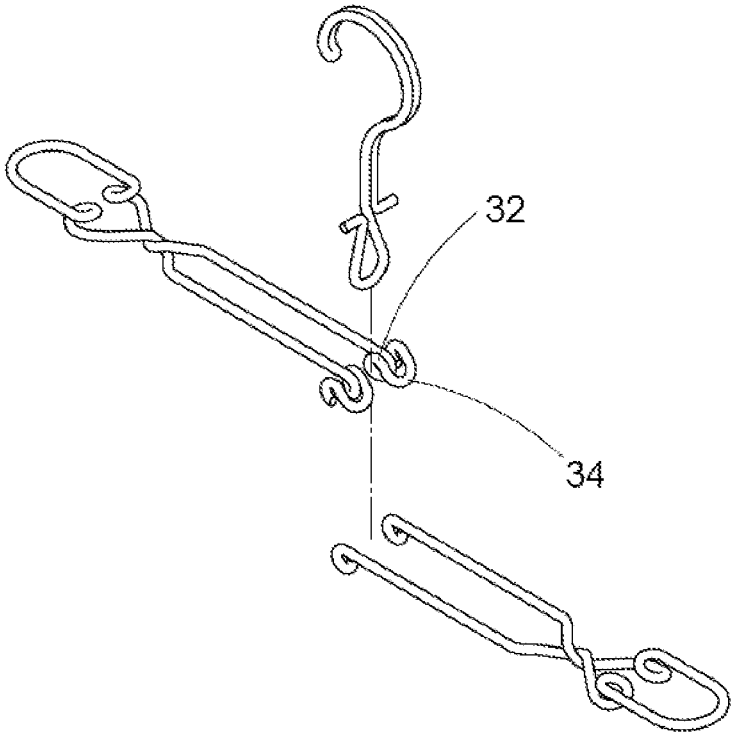
FIG. 11 is an exploded view of the second embodiment of the invention.
Figure 12:
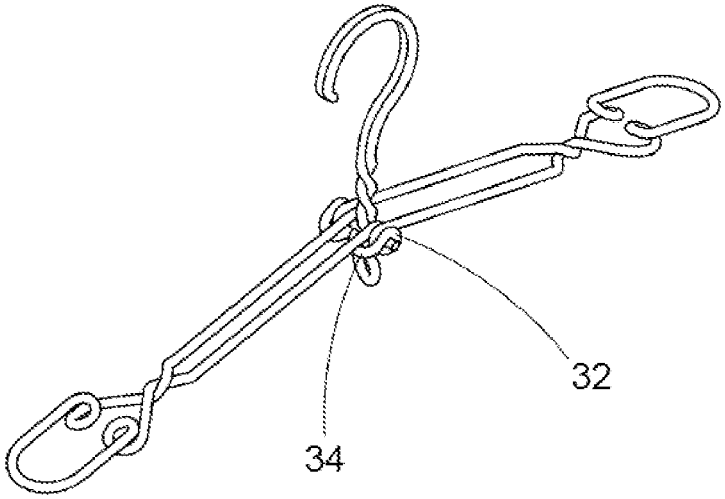
FIG. 12 is a perspective view of the third embodiment of the invention.
Figure 13:
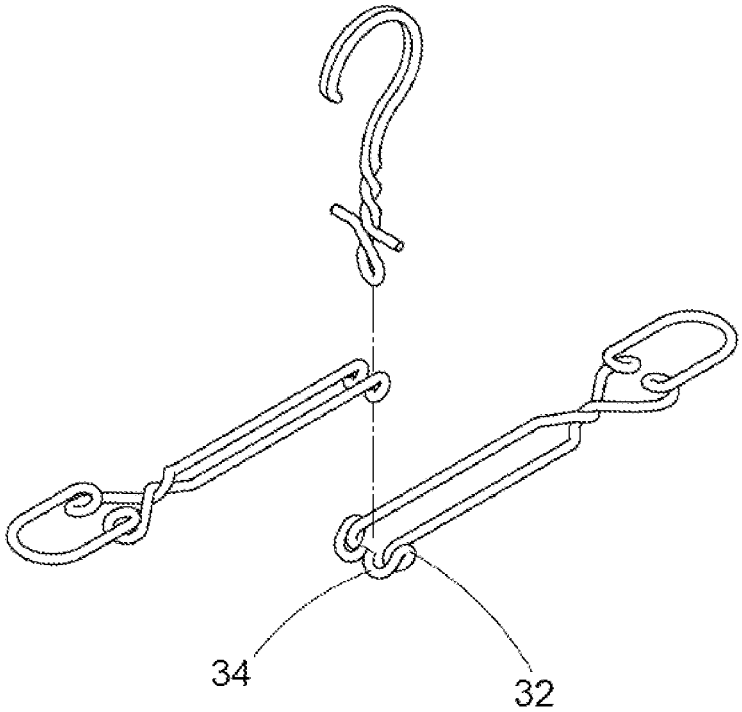
FIG. 13 is an exploded view of the third embodiment of the invention.

It should be pointed out that the configurations of the second pivot rings and of the stop sections are not limited to those in the first embodiment. For example, in the second embodiment shown in FIG. 10 and FIG. 11 and in the third embodiment shown in FIG. 12 and FIG. 13, the second pivot rings 32 and the stop sections 34 are shaped slightly differently from their respective counterparts in the first embodiment but still allow the hangers to be collapsed on the same working principle.

The embodiments described above are only some preferred ones of the present invention and should not be construed as limiting the scope of the invention. Any equivalent changes or modifications based on the appended claims shall fall within the scope of the invention.

What is claimed is:

1. A collapsible hanger, comprising:

a hook unit having a hook and a pair of coaxially extending pivot shafts;

a first hanger body having a pair of first extensions and a pair of first pivot rings, wherein the first hanger body is pivotable between a first collapsed portion and a first extended position with respect to the hook unit, and the pair of first pivot rings are connected to the pair of first extensions respectively and are pivotally sleeved on the pair of pivot shafts respectively; and a second hanger body having a pair of second extensions, a pair of second pivot rings, and at least one stop section, wherein the second hanger body is pivotable between a second collapsed position and a second extended position with respect to the hook unit, the pair of second pivot rings are connected to the pair of second extensions respectively and are pivotally sleeved on the pair of pivot shafts respectively, and each of the at least one stop section is fixed on one of the pair of second pivot rings;

wherein the first hanger body and the second hanger body separate a top-side space and a bottom-side space from each other when at the first extended position and the second extended position respectively, the top-side space lies above the first hanger body and the second hanger body, and the bottom-side space is directly below the first hanger body and the second hanger body;

wherein when the first hanger body and the second hanger body are at the first extended position and the second extended position respectively and the hook is in the top-side space, the at least one stop section and at least one of the pair of first extensions interfere with each other such that the first hanger body and the second hanger body cannot pivot away from the hook simultaneously but are allowed to pivot toward the first collapsed position and the second collapsed position respectively.

2. The collapsible hanger of claim 1, wherein the hook unit is integrally formed by bending.

3. The collapsible hanger of claim 1, wherein the first hanger body is integrally formed by bending.

4. The collapsible hanger of claim 1, wherein the second hanger body is integrally formed by bending.

5. The collapsible hanger of claim 1, wherein a gap is define between at least one of the pair of first extensions and the pair of second extensions to allow passage of the hook.

6. The collapsible hanger of claim 5, wherein when the first hanger body and the second hanger body are at the first extended position and the second extended position respectively and the hook is in the top-side space, the hook unit is pivotable with respect to the first hanger body and the second hanger body in order to pivot the hook to the bottom-side space.

7. The collapsible hanger of claim 1, wherein the hook unit further has a hanging ring, the pair of pivot shafts are located between the hook and the hanging ring, and when the first hanger body and the second hanger body are at the first extended position and the second extended position respectively and the hook is in the top-side space, the hanging ring is in the bottom-side space.

8. The collapsible hanger of claim 1, wherein each of the pair of first extensions and the pair of second extensions has a spiral section, and each said spiral section defines a groove so that each shoulder strap of a garment to be hung from the collapsible hanger is engageable in a corresponding one of the grooves.

9. The collapsible hanger of claim 1, wherein the first hanger body further has a first connecting section, and the first connecting section is connected to an end of the pair of first extensions that is distant from the pair of first pivot rings.

10. The collapsible hanger of claim 1, wherein the second hanger body further has a second connecting section, and the second connecting section is connected to an end of the pair of second extensions that is distant from the pair of second pivot rings.

* * * * *